US009833032B2

(12) United States Patent
Jacobsen

(10) Patent No.: US 9,833,032 B2
(45) Date of Patent: Dec. 5, 2017

(54) MULTI-BODY HELMET CONSTRUCTION WITH SHIELD MOUNTING

(71) Applicant: Bell Sports, Inc., Scotts Valley, CA (US)

(72) Inventor: Gregg T. Jacobsen, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 237 days.

(21) Appl. No.: 14/640,178

(22) Filed: Mar. 6, 2015

(65) Prior Publication Data

US 2015/0250249 A1 Sep. 10, 2015

Related U.S. Application Data

(60) Provisional application No. 61/949,924, filed on Mar. 7, 2014.

(51) Int. Cl.

| | |
|---|---|
| ***A42B 3/00*** | (2006.01) |
| ***A42B 3/06*** | (2006.01) |
| ***A42B 3/08*** | (2006.01) |
| ***A42B 3/22*** | (2006.01) |
| ***A42B 3/28*** | (2006.01) |
| ***A42B 3/12*** | (2006.01) |
| ***A42B 3/14*** | (2006.01) |

(52) U.S. Cl.

CPC ..... *A42B 3/06* (2013.01); *A42B 3/08* (2013.01); *A42B 3/12* (2013.01); *A42B 3/147* (2013.01); *A42B 3/221* (2013.01); *A42B 3/283* (2013.01)

(58) Field of Classification Search

CPC ... A42B 3/18; A42B 3/185; A42B 3/22–3/228
USPC ..... 2/6.3, 6.5
See application file for complete search history.

(56) References Cited

U.S. PATENT DOCUMENTS

| | | | | |
|---|---|---|---|---|
| 3,601,813 A * | 8/1971 | Aileo | ..... | A42B 3/228 2/410 |
| 4,932,076 A | 6/1990 | Giorgio | | |
| 5,555,570 A * | 9/1996 | Bay, Jr. | ..... | A42B 3/22 2/422 |
| 5,890,233 A * | 4/1999 | Kaffka | ..... | A42B 3/226 2/10 |

(Continued)

FOREIGN PATENT DOCUMENTS

| | | |
|---|---|---|
| EP | 1714569 | 10/2006 |
| WO | WO2006005183 | 1/2006 |
| WO | WO2013020932 | 2/2013 |

*Primary Examiner* — Khaled Annis
(74) *Attorney, Agent, or Firm* — Booth Udall Fuller, PLC

(57) ABSTRACT

A helmet can comprise an upper-body and a lower-body nested within the upper-body. An opening can be formed within a front portion of the helmet and disposed between an outer surface of the upper-body and an inner surface of the lower-body. A first magnet can be encased within the upper-body or the lower-body and adjacent the opening. A shield can comprise a shield mount and a second magnet coupled to the shield mount that is sized to fit within the opening and to be releasably coupled to the first magnet. The first magnet and the second magnet can be self-aligned in direct alignment with eyes of a user. A third magnet can be disposed above the first magnet and aligned with the second magnet on an outer surface of the helmet out of sight from eyes of the user.

19 Claims, 4 Drawing Sheets

(56) References Cited

U.S. PATENT DOCUMENTS

| | | | | |
|---|---|---|---|---|
| 6,170,084 | B1 * | 1/2001 | Gordon | A42B 3/227 2/12 |
| 6,174,058 | B1 * | 1/2001 | Hsiao | A42B 1/062 2/10 |
| 2005/0078273 | A1 * | 4/2005 | Holm | A42B 3/185 351/155 |
| 2009/0000015 | A1 * | 1/2009 | Ahn | A42B 3/227 2/422 |
| 2011/0069273 | A1 * | 3/2011 | Lu | G02C 3/02 351/51 |
| 2012/0233747 | A1 * | 9/2012 | Ko | A42B 3/226 2/424 |
| 2012/0291173 | A1 * | 11/2012 | Gleason | A42B 3/225 2/10 |
| 2012/0291227 | A1 * | 11/2012 | Fiedler | A42B 3/04 24/3.3 |
| 2013/0283508 | A1 * | 10/2013 | Durham | A42B 3/0406 2/422 |
| 2014/0173811 | A1 * | 6/2014 | Finiel | A42B 3/185 2/422 |

* cited by examiner

MULTI-BODY HELMET CONSTRUCTION WITH SHIELD MOUNTING

RELATED APPLICATIONS

This application claims the benefit of U.S. provisional patent application 61/949,924, filed Mar. 7, 2014 titled "Multi-Body Helmet Construction and Strap Attachment Method," the entirety of the disclosure of which is incorporated by this reference.

TECHNICAL FIELD

This disclosure relates to a helmet comprising multi-body helmet construction with shield mounting, such as sunglasses. The multi-body helmet and shield can be employed wherever a conventional helmet and shielding is used with additional benefits as described herein.

BACKGROUND

Protective headgear and helmets have been used in a wide variety of applications and across a number of industries including sports, athletics, construction, mining, military defense, and others, to prevent damage to a user's head and brain. Damage and injury to a user can be prevented or reduced by helmets that prevent hard objects or sharp objects from directly contacting the user's head. Damage and injury to a user can also be prevented or reduced by helmets that absorb, distribute, or otherwise manage energy of an impact.

For helmet-wearing athletes in many applications, such as sports, beyond the safety aspects of the protective helmet, additional considerations can include helmet fit and airflow through the helmet. Improvements in fit comfort and airflow can reduce distractions to the athlete and thereby improve performance. Thus, helmet design and construction can relate to use safety, as well as to improvements in fit, airflow, and comfort for a user without reducing or compromising safety.

In some instances, a user can desire eye protection in addition to the head protection provided by a helmet. As such, a user will at times wear a shield, eye-shield, safety glasses, or sunglasses at a same time a helmet is worn for head protection. At times, attachment or coupling mechanisms for the helmet and the eye shield can interfere with each other, or can be uncomfortable, bulky, or cumbersome, which is undesirable for a user.

SUMMARY

A need exists for providing both a helmet for head protection and eye protection to a user that is not uncomfortable, bulky, or cumbersome. Accordingly, in an aspect, a helmet can comprise an upper-body comprising an upper outer shell and an upper energy-absorbing material coupled the upper outer shell. The helmet can comprise a lower-body comprising an lower outer shell and a lower energy-absorbing material coupled the outer shell, wherein the lower-body is nested within the upper-body. The helmet can comprise an opening formed within a front portion of the helmet and disposed between an outer surface of the upper-body and an inner surface of the lower-body. The helmet can comprise a first magnet encased within the upper energy-absorbing material or the lower energy-absorbing material and adjacent the opening. The helmet can comprise a shield comprising a shield mount and a second magnet coupled to the shield mount that is sized to fit within the opening and to be releasably coupled to the first magnet.

The helmet can further comprise the first magnet disposed between the outer surface of the upper-body and the opening or between the inner surface of the lower-body and the opening. The first magnet can comprise a surface that is substantially coplanar with a surface of the opening. The upper-energy absorbing material can comprise expanded polypropylene (EPP), expanded polystyrene (EPS), expanded polyurethane (EPU), or expanded polyolefin (EPO), and the lower-energy absorbing material comprises EPP, EPS, EPU, or EPO. The upper-energy absorbing material can comprise a density in a range of 70-100 g/L, and the lower-energy absorbing material can comprise a density in a range of 50-80 g/L. The first magnet and the second magnet can be self-aligned with respect to each other such that the shield can be magnetically coupled to the upper-body or the lower-body in direct alignment with eyes of a user. A third magnet can be encased within the upper-body or the lower-body above the first magnet, and the second magnet and the third magnet can be aligned such that the shield can be magnetically coupled to an outer surface of the helmet out of sight from eyes of the user.

In another aspect, a helmet can comprise an upper-body, a lower-body nested within the upper-body, and an opening formed within a front portion of the helmet and disposed between the upper-body and the lower-body. A first magnet can be disposed within the upper-body or the lower-body and adjacent the opening. A shield can comprise a shield mount and a second magnet coupled to the shield mount that is sized to fit within the opening and to be releasably coupled to the first magnet.

The helmet can further comprise the first magnet being disposed between an outer surface of the upper-body and the opening or between an inner surface of the lower-body and the opening. The first magnet can comprise a surface that is substantially coplanar with a surface of the opening. The upper-body can comprise an upper energy-absorbing material comprising EPP, EPS, EPU, or EPO, and the lower-body can comprise a lower energy-absorbing material comprising EPP, EPS, EPU, or EPO. The upper-energy absorbing material can comprise a density in a range of 70-100 g/L, and the lower-energy absorbing material can comprise a density in a range of 50-80 g/L. The first magnet and the second magnet can be self-aligned with respect to each other such that the shield can be magnetically coupled within the opening in direct alignment with eyes of a user. A third magnet can be disposed within the upper-body or the lower-body and above the first magnet, and the second magnet and the third magnet can be aligned such that the shield can be magnetically coupled to an outer surface of the helmet out of sight from the eyes of the user.

In another aspect, a method of using the helmet can comprise an upper-body, a lower-body nested within the upper-body, an opening formed between the upper-body and the lower-body, and a shield comprising a shield mount that is sized to be releasably fit within the opening.

The method of using the helmet can further comprise the shield being magnetically coupled within the opening. A first magnet can be disposed between an outer surface of the upper-body and the opening or between an inner surface of the lower-body and the opening, and a second magnet can be coupled to the shield mount. The upper-body can comprise an upper energy-absorbing material comprising EPP, EPS, EPU, or EPO; and the lower-body can comprise a lower energy-absorbing material comprising EPP, EPS, EPU, or EPO. A first magnet can be disposed within the upper-body or the lower-body. A second magnet can be coupled to the shield mount so that the first magnet and the second magnet are self-aligned with respect to each other for the shield to be magnetically coupled within the opening in direct alignment with eyes of a user. A third magnet can be disposed above the first magnet, and the second magnet and the third magnet can be aligned such that the shield can be magnetically coupled to an outer surface of the helmet out of sight from the eyes of the user.

DETAILED DESCRIPTION

Figure 1:
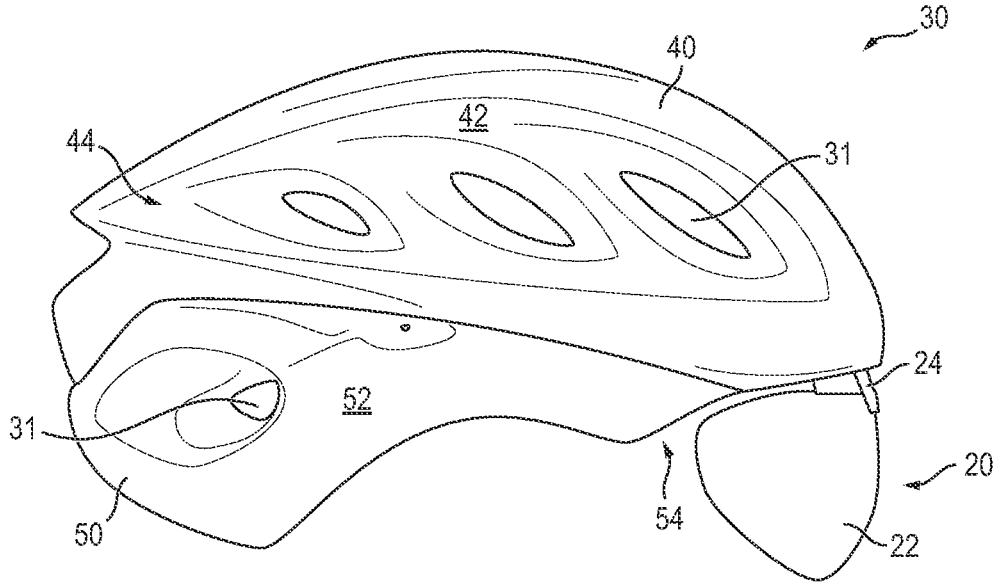
FIG. 1 shows a side view of an embodiment of a multi-body helmet comprising a shield.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

This disclosure provides a device, apparatus, system, and method for providing a protective helmet that can include an outer shell and an inner energy-absorbing layer, such as foam. The protective helmet can be a bike helmet used for mountain biking or road cycling, as well as be used for a skier, skater, hockey player, snowboarder, or other snow or water athlete, a football player, baseball player, lacrosse player, polo player, climber, auto racer, motorcycle rider, motocross racer, sky diver or any other athlete in a sport. Other industries also use protective headwear, such that individuals employed in other industries and work such as construction workers, soldiers, fire fighters, pilots, or types of work and activities can also use or be in need of a safety helmet, where similar technologies and methods can also be applied. Each of the above listed sports, occupations, or activities can use a helmet that includes either single or multi-impact rated protective material base that is typically, though not always, covered on the outside by a decorative cover and includes comfort material on at least portions of the inside, usually in the form of comfort padding.

Generally, protective helmets, such as the protective helmets listed above, can comprise an outer shell and in inner energy-absorbing material. For convenience, protective helmets can be generally classified as either in-molded helmets or hard shell helmets. In-molded helmets can comprise one layer, or more than one layer, including a thin outer shell, an energy-absorbing layer or impact liner, and a comfort liner or fit liner. Hard-shell helmets can comprise a hard outer shell, an impact liner, and a comfort liner. The hard outer shell can be formed by injection molding and can include Acrylonitrile-Butadiene-Styrene (ABS) plastics or other similar or suitable material. The outer shell for hard-shell helmets is typically made hard enough to resist impacts and punctures, and to meet the related safety testing standards, while being flexible enough to deform slightly during impacts to absorb energy through deformation, thereby contributing to energy management. Hard-shell helmets can be used as skate bucket helmets, motorcycle helmets, snow and water sports helmets, football helmets, batting helmets, catcher's helmets, hockey helmets, and can be used for BMX riding and racing. While various aspects and implementations presented in the disclosure focus on embodiments comprising in-molded helmets, the disclosure also relates and applies to hard-shell helmets.

FIG. 1 shows a side profile view of a non-limiting example of a multi-body helmet 30 that comprises vents or openings 31 and an upper-body 40 and a lower-body 50. For convenience, the multi-body helmet 30 is referred to throughout the application as a two-body helmet, or bifurcated helmet, comprising the upper-body 40 and a lower-body 50, or first and second bodies or portions. However, the present disclosure encompasses multi-body helmets that comprise more than two bodies, such as three, four, or any suitable number of bodies, and use of the term two-body helmet or a bifurcated helmet is intended to encompass helmets with two or more bodies. The upper-body 40 and the lower-body 50 can be joined to form a single multi-body helmet 30, as shown in FIG. 1, which is a departure from the conventional single body helmets described generally above. FIG. 1 shows the upper-body 40 and the lower-body 50 of the multi-body helmet 30 adjacent, aligned, and in contact with each other.

The upper-body 40 can comprise an outer shell 42 and an energy-absorbing layer or impact liner 44, although the upper-body 40 need not have both. For example, in some embodiments the upper-body 40 can comprise the energy-absorbing layer 44 without the outer shell 42. Vents or openings 41 can be formed in the upper-body 40 that form, comprise, or align with at least a portion of the vents 31. Similarly, the lower-body 50 can comprise an outer shell 52 and an energy-absorbing layer or impact liner 54, although the lower-body 50 need not have both. For example, in some embodiments the lower-body 50 can comprise the energy-absorbing layer 54 without the outer shell 52. Vents or openings 51 can be formed in the lower-body 50 that form, comprise, or align with at least a portion of the vents 31, vents 41, or both.

The outer shells 42 and 52 can each, without limitation, be formed of a plastic, resin, fiber, or other suitable material including polycarbonate (PC), polyethylene terephthalate (PET), acrylonitrile butadiene styrene (ABS), polyethylene (PE), polyvinyl chloride (PVC), vinyl nitrile (VN), fiberglass, carbon fiber, or other similar material. The outer shells 42 and 52 can be stamped, in-molded, injection molded, vacuum formed, or formed by another suitable process. Outer shells 42 and 52 can provide a shell into which the energy-absorbing layers 44 and 54, respectively, can be in-molded. Outer shells 42 and 52 can also provide a smooth aerodynamic finish, a decorative finish, or both, for improved performance, improved aesthetics, or both. As a non-limiting example, the outer shells 42 and 52 can comprise PC shells that are in-molded in the form of a vacuum formed sheet, or are attached to the energy-absorbing layers 44 and 54, respectively, with an adhesive. The outer shells 42 and 52 can also be permanently or releasably coupled to the energy-absorbing layers 44 and 54, respectively, using any suitable chemical or mechanical fastener or attachment device or substance including without limitation, an adhesive, permanent adhesive, pressure sensitive adhesive (PSA), foam-core adhesive, tape, two-sided tape, mounting foam adhesive, fastener, clip, cleat, cutout, tab, snap, rivet, hog ring, or hook and loop fasteners.

In some embodiments, the outer shells 42 and 52 can be formed on, or cover, an entirety of the energy-absorbing layers 44 and 54, respectively. Alternatively, the outer shells 42 and 52 can be formed on, or cover, a portion of the energy-absorbing layers 44 and 54 that is less than an entirety of the energy-absorbing layers 44 and 54, respectively. As a non-limiting example, in some embodiments the outer shell 52 can be limited to a lower portion of the lower-body 50 that will not be covered or will remain exposed with respect to outer shell 42 of upper-body 40. As such, the upper portion of the lower-body 50 can be formed without outer shell 52.

The energy-absorbing layers 44 and 54 can each be disposed inside, and adjacent, the outer shells 42 and 52, respectively. The energy-absorbing layers 44 and 54 can be made of plastic, polymer, foam, or other suitable energy-absorbing material or impact liner to absorb, deflect, or otherwise manage energy and to contribute to energy management for protecting a wearer during impacts. The energy-absorbing layers 44 and 54 can include, without limitation, expanded polypropylene (EPP), EPS, expanded polyurethane (EPTU or EPU), expanded polyolefin (EPO), or other suitable material. As indicated above, in-molded helmets can be formed with the outer shell of the helmet being bonded directly to the energy-absorbing layer by expanding foam into the outer shell. As such, the energy-absorbing layers 44 and 54 can, in some embodiments, be in-molded into outer shells 42 and 52, respectively, as single monolithic bodies of energy-absorbing material. Alternatively, in other embodiments the energy-absorbing layers 44 and 54 can be formed of multiple portions or a plurality of portions. In any event, the energy-absorbing layers 44 and 54 can absorb energy from an impact by bending, flexing, crushing, or cracking.

By forming the multi-body helmet 30 with multiple bodies or portions, such as upper-body 40 and lower-body 50, the multi-body helmet 30 can advantageously and easily provide a multiple density design. For example, the upper-body 40 and the lower-body 50 can be formed of energy-absorbing materials of different densities and energy management properties, wherein the energy-absorbing material 44 can comprise a first density, and the energy-absorbing material 54 can comprise a second density different from the first density. The first density can be greater than or less than the first density. In an embodiment, the energy-absorbing material 44 can comprise a density in a range of 70-100 g/L and the energy-absorbing material 54 can comprise a density in a range of 50-80 g/L. Additionally, multiple layers of varying density, including increasing density, decreasing density, or mixed density, can be combined. By forming a single multi-body helmet 30 that comprises a plurality of densities for a plurality of bodies or components, helmet performance including helmet weight, and testing performance, can be manipulated and optimized with greater freedom and fewer restrictions than is available with a single bodied helmet.

By forming the multi-body helmet 30 with multiple interlocking bodies or portions, such as upper-body 40 and lower-body 50, the multi-body helmet 30 can also provide increased design flexibility with respect to conventional one-body or monolithic protective helmets. Increased design flexibility can be achieved by forming the upper-body 40 and the lower-body 50 comprising shapes, geometric forms, and orientations that would be difficult to accomplish with a single body liner. Constraints restricting shapes, geometric forms, and orientations of a single body liner include constraints for injecting foam or energy-absorbing material into a mold, constraints of removing the molded foam or energy-absorbing material from the mold, and constraints of machining or removing the single body liner from a template or standard blank of material such as a block of energy-absorbing material. For example, use of multiple interlocking body pieces for a single helmet can allow for helmet shapes, geometric forms, and orientations that would be difficult or impossible to remove or pull from a 1-piece mold. As a non-limiting example, increased design flexibility with respect to helmet shape for the multi-body helmet 30 can include a helmet comprising a curvature or profile that follows a contour of the occipital region or occipital curve of user's head. Furthermore, increased design flexibility for upper-body 40 and lower-body 50 can be achieved by simplifying the simplify the assembly of energy-absorbing material for multi-body helmet 30 at an EPS press.

FIG. 1 also shows a shield, lens, sunglasses, or visor 20 that can be releasably coupled to the multi-body helmet 30. The shield 20 can comprise a lens or lens portion 22 and a shield mount, rim, frame, or attachment portion 24 coupled to the lens 22. In some embodiments, the lens 22 and the shield mount 24 can be integrally formed of a single material. In other embodiments, the lens 22 and the shield mount 24 can be formed of two or more separate or discrete portions that can be subsequently coupled or attached to each other using any suitable chemical or mechanical attachment, including without limitation, an adhesive, permanent adhesive, fastener, clip, cleat, cutout, tab, snap, rivet, hog ring, or other interlocking surface, feature, or portion.

The lens 22 can comprise one, two, or any number of separate or discrete suitable members. In some instances a single large lens can cover both eyes of a user, while in other embodiments, a separate lens can be used to separately cover each of the eyes of the user. However, for ease of description, the lens 22 will be referred to in the singular, even when multiple lenses might be used. The lens 22 can comprise, glass, plastic, or other suitable material to shield or protect a user's eyes from wind, debris, and flying objects. The lens 22 can also be tinted or polarized to reduce an amount of EM radiation arriving at the eyes of a helmet user, including for example, bright visible light, reflections and glare, and harmful radiation such as UV rays. The lens 22 can also be configured to improve a user's eyesight by including one or more prescription lenses, such as lenses used for correcting vision in eyeglasses. Furthermore, the lens 22 can also comprise a "heads-up display" for receiving and displaying desired information such as computer generated information or wirelessly transmitted information for viewing by the helmet user. When used as a heads-up display, an entirety of the lens 22 or a portion of the lens 22 that is less than an entirety of the lens 22 can be used for displaying desired information, for the user to view, read, or use from the lens 22.

The shield 20 can be releasably coupled to the multi-body helmet 30 using magnets, latches, clips, or other mechanical fasteners, either alone or together, which can allow the user to easily attach and remove the shield 20 to the multi-body helmet 30. In an embodiment, magnets 26 can be used without additional mechanical attachment to releasably couple the shield 20 to the multi-body helmet 30. As such, the shield 20 can be easily coupled and uncoupled to the multi-body helmet 30 when the helmet user is either stopped or riding. Conventional or traditional shields that have been configured to be releasably coupled to a helmet have included cumbersome attachment devices that made attachment or releasing of the shield difficult, impractical, or impossible when the user was riding or on-the-go. As such, releasably coupling the shield 20 to the multi-body helmet 30 with magnets 26 and without additional mechanical attachment can facilitate proper and secure positioning of the shield 20 with respect to a face or eyes of the user, which can be easily and conveniently accomplished by the user even while riding. Similarly, releasably coupling the shield 20 to the multi-body helmet 30 with magnets 26 and without additional mechanical attachment can facilitate proper and secure positioning of the shield 20 on the helmet away from the eyes, such as for storage of the shield 20, which can be easily and conveniently accomplished by the user even while riding.

Figure 2:
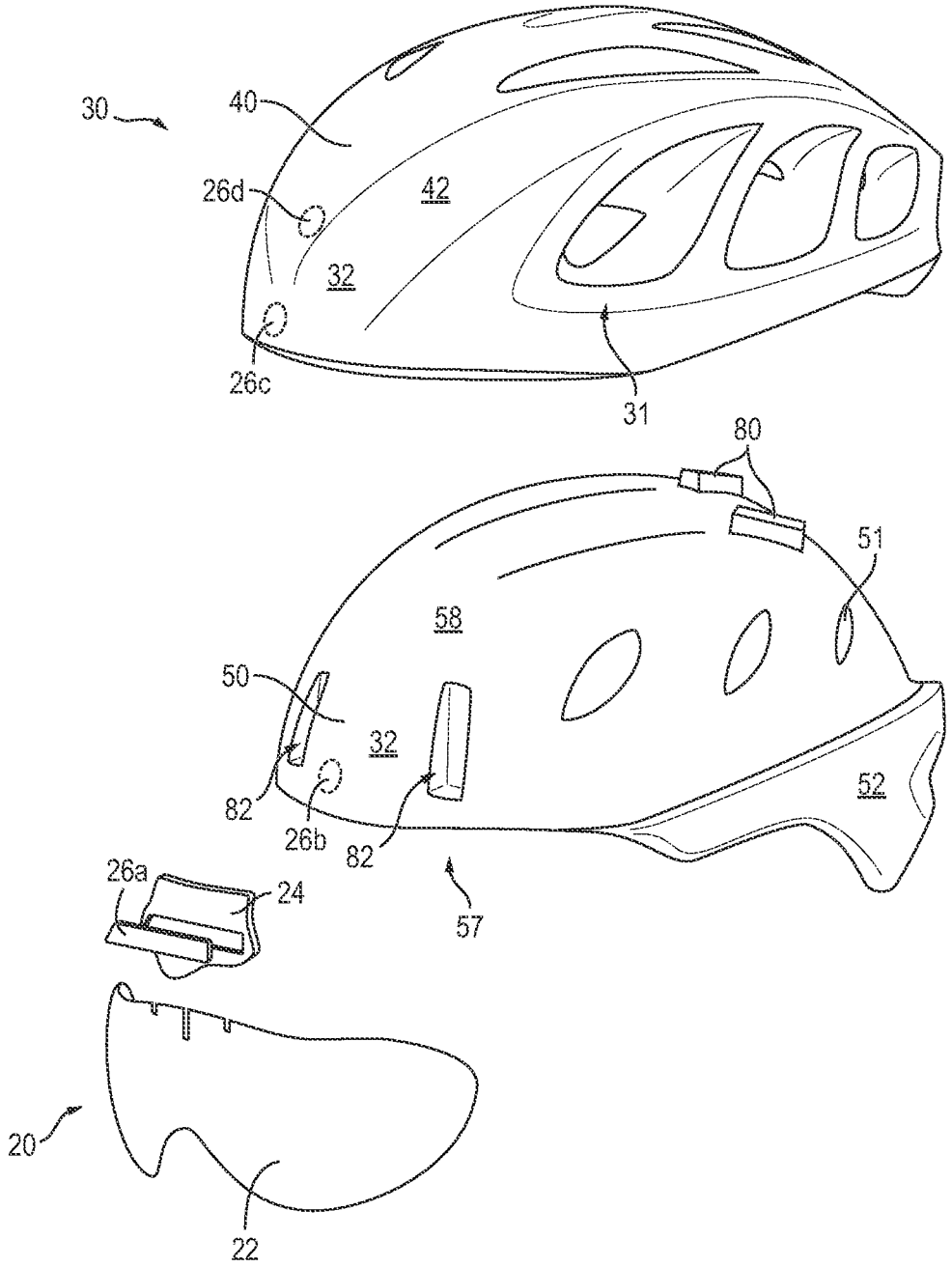
FIG. 2 shows an exploded perspective view of an upper-body, lower-body, and shield of a multi-body helmet.

FIG. 2 shows an exploded perspective view of the multi-body helmet 30, in which the upper-body 40 and the lower-body 50 of the multi-body helmet 30 are vertically separated by a gap or space while being aligned with respect to each other, such as before the upper-body 40 and the lower-body 50 are placed in contact with, or adjacent, one another. From the separated position shown in FIG. 2, the upper-body 40 and lower-body 50 can be drawn together into the adjacent positioning shown in FIG. 1. The upper-body 40 and lower-body 50 can also be coupled or adhered together using any suitable chemical or mechanical fastener, attachment device, or substance including without limitation, an adhesive, permanent adhesive, PSA, foam-core adhesive, tape, two-sided tape, mounting foam adhesive, fastener, clip, cleat, cutout, tab, snap, rivet, hog ring, or hook and loop fasteners, or other interlocking surfaces, features, or portions. Such interlocking features can limit, prevent, or regulate undesired relative movement between the multiple bodies such as the upper-body 40 and the lower-body 50. In some instances, a predetermined shear strength can be built into the interlocking features to shear or fail at predetermined levels of force. As a non-limiting example, the multi-body helmet 30 can comprise bumps or pop-outs 80 as well as indents 82 to assist in coupling together the upper-body 40 and the lower-body 50 together to form the multi-body helmet 30. More specifically, FIG. 2 shows the bumps 80 and indents 82 can be formed on the outer surface 58 of the lower-body 50 and be configured, by size, shape, and position, to be mateably coupled with corresponding bumps and indents on inner surface 46 of the upper-body 40. The interlocking features of bumps 80 and indents 82 can help facilitate a stronger connection and better alignment between the upper-body 40 and the lower-body 50 of the multi-body helmet 30.

FIG. 2 also shows that shield 20 can comprise a lens 22, as well as a shield mount 24 that can be attached or coupled to the lens 22. The shield mount 24 can also comprise one or more attachment devices, such as one or more magnets 26, for releasably coupling the shield 20 to the multi-body helmet 30. The magnets 26 can be of any desirable size, strength, or shape. While any number of magnets 26 can be used for releasably coupling the shield 20 to the multi-body helmet 30, such as one, two, or three magnets, FIG. 2 shows a non-limiting example in which three or four magnets can be used. The magnets 26 shown in FIG. 2 are shown in dashed lines, indicating that the magnets 26 can be contained within the various structures of the multi-bodied helmet 30, or the shield 20, without being visible at a surface of the respective structures. For example, a first magnet 26*a* can be disposed within the shield mount 24, and a corresponding second magnet 26*b*, 26*c*, or both, can be disposed within the multi-body helmet 30. FIG. 2 shows a non-limiting example in which the magnet 26*b* can be disposed within the lower-body 50 for releasably coupling the magnet 26*a* and the shield 20 to the lower-body 50. Similarly, FIG. 2 also shows a non-limiting example in which the magnet 26*c* can be disposed within the upper-body 40 for releasably coupling the magnet 26*a* and the shield 20 to the upper-body 50.

The magnets 26 disposed within the multi-bodied helmet 30, such as magnets 26*b* and 26*c*, can be positioned so as to be releasably coupled to, and act as focus points for, the magnet 26*a* disposed within the shield mount 24. A proximity or distance of between the magnet 26*a* in the shield mount 20 with the magnets 26*b* or 26*c* inside the lower-body 50 and the upper-body 40, respectively, can cause the shield 20 and the shield mount 24 to self-locate or automatically align at a desired position on a brow portion 32 of the multi-body helmet 30. The desired position of magnets 26*b* and 26*c* on the brow portion 32 of the helmet 30 can take into account a desired or preferred location or alignment between a face or eyes of a user and the shield 20 or the lens 22. The desired position of the shield 20 on the brow portion 32 of the helmet 30 can similarly take into account a desired or preferred offset or distance between the face or the eyes of the user and the shield 20 or lens 22.

Figure 3:
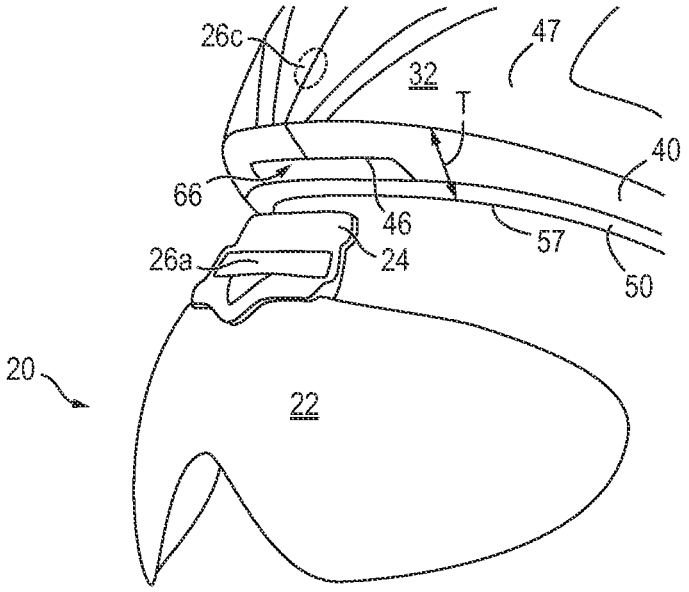
FIG. 3 shows a close-up view of releasably couplable shield aligned with an opening within a multi-body helmet.

The desired position of the magnets 26*b* and 26*c* can be determined based on which position will best facilitate positioning the shield 20 at a desirable or optimal position for the helmet user. The optimal or desired position of the shield 20 can be along the thickness T of the multi-body helmet 30, as shown in FIG. 3. Placement of the magnets 25*b* and 26*c* for coupling the shield 20 at the desired or optimal position can be made possible by positioning the magnets 26*b* and 26*c* within the upper-body 40 and lower-body 50 by using multiple in-molded shells, such as outer shell 42 for upper-body 40 and the outer shell 52 for the lower-body 50, for positioning the magnets 26 within the multi-body helmet 30. By integrating the attachment of the shield 20 within the thickness T of the multi-body helmet 30, the shield 20 need not be positioned on an inner surface of the helmet, such as at the inner surface 57 of the lower-body 50, or at an outer surface of the helmet, such as at the outer surface 47 of the upper body 40. Furthermore, the shield 20 need not be attached to the multi-bodied helmet 30 with the use of a complicated or cumbersome attachment device for adjusting a position of the shield 20 from its natural position at the inner surface or outer surface of the helmet, to the desired position. Instead, the shield mount 24 can be a simple device that can be directly inserted into the opening 66 or into a separation between the upper-body 40 and the lower-body 50 at a brow portion 32 of the multi-body helmet 30.

Figure 6:
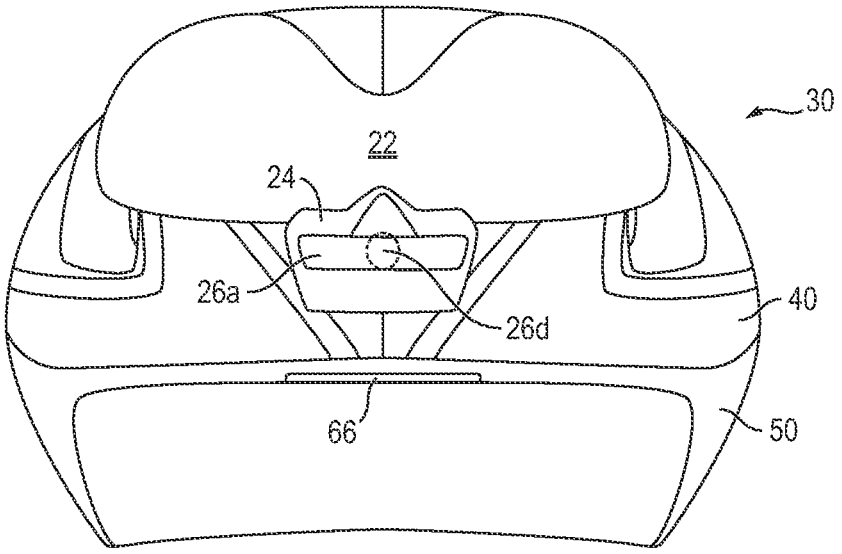
FIG. 6 shows a front profile view of a shield coupled to a multi-body helmet in a storage position.

Additional magnets 26, such as a third or fourth magnet 26*d* can also be included as part of the multi-body helmet 30. A position of the fourth magnet 26*d* can facilitate convenient storage of the shield 20 in a storage position, such as when the rider chooses not to wear the shield in a normal riding position, such as is shown in FIG. 6.

Advantages of positioning and locating the magnets 26 within the multi-body helmet 30 can be understood with respect to placement of components within conventional in-molded helmets. Conventional in-molded helmets, such as in-molded helmets comprising PC shells, are conventionally formed with the shells being in-molded on a face of a tool wall or mold used for in-molding foam into the shell and the foam mold. As such, components to be formed or in-molded within the foam, such as clips, anchors, magnets, lights, or other structures, are placed in direct contact with the outer shell to be held in place while an energy-absorbing foam material, such as EPS or other suitable material, is in-molded within the shell. The components being in-molded within the shell are conventionally in direct contact with the outer shell to prevent the components from being displaced or moved by the foam or energy-absorbing material being in-molded into the shell. As such, in-molded components disposed within the energy-absorbing material are located within the energy-absorbing material with at least a portion of the component in contact with, or adjacent, the shell. As such, convention single-body in-molded helmets have not included components being in-molded or placed in a center portion of the helmet, but have been limited by having the components disposed at a exterior portion of the energy-absorbing material adjacent the shell for the engineering reasons disclosed above. Additionally, business considerations have also limited the placement of in-molded components at a center of an in-molded layer. For example, placing the components in the energy-absorbing material after molding would make the placement of the components, such as magnets 26, cumbersome, time-intensive, or cost-prohibitive, by requiring additional manufacturing steps to place components within an already molded energy absorbing material.

To the contrary, bifurcation or use of multiple bodies as part of an in-molded helmet, such as formation of the multi-body helmet 30, can allow for greater possibilities with respect to placement of internal components, such as magnets 26. Greater flexibility in component placement can be achieved because components coupled to a surface of a shell in an in-molded helmet can disposed at an inner portion of the multi-body helmet when the multiple bodies of the multi-body helmet coupled together. For example, placement of a component, such as a magnet 26, in contact with the outer surface 58 of lower-body 50, or to the inner surface 46 of the upper-body 40, can result in the component or magnet 26 being disposed at an inner portion of the multi-body helmet 30, when the upper-body 40 and the lower-body 50 are coupled together. By forming the components, such as magnets 26, within the energy-absorbing layer as part of a conventional in-molding process, the magnets 26 can be disposed within a mold before the molding process begins to efficiently and cost effectively provide the magnets at a center portion of the helmet, within a central portion of the thickness T of the multi-body helmet 30. In some embodiments, the central portion of the thickness T, such as where the magnets 26 are disposed, can include a portion of the thickness T that is offset from an inner or outer edge of the multi-body helmet 30, such as inner surface 57 of the lower-body 50 or the outer surface 47 of the upper-body 40 by a distance that is greater than 1 millimeter (mm), 2 mm, 3 mm, 4 mm, 5 mm, 7 mm, 10 mm or more.

Therefore, by including the in-molded components, such as magnets 26, within a conventional in-molding process for multiple bodies of a multi-body helmet, a number of advantages can be realized. First, the magnets 26 can be disposed within the energy-absorbing material during the in-molding process to avoid the inefficiencies present with insertion of the magnets into an already in-molded helmet or helmet component, such as by forming a void in the already molded energy absorbing material, and subsequently adding the magnet 26 to the void, and filling a portion of the void not occupied by the magnet. Second, in-molding the magnets within multiple bodies of the multi-body helmet 30, such as at the outer surface 58 of the lower-body 50, or the inner surface 46 of the upper-body 40, allows for the magnet 26 to be disposed within a central or inner portion of the multi-body helmet 30, away from the outer and inner surface of the multi-body helmet, such as the inner surface 57 of the lower-body 50 and the outer surface 47 of the upper-body 40.

As indicated above, and as shown in FIG. 3, the multi-body helmet 30 can facilitate or allow for greater choice in the location or position of the shield 20 with respect to a thickness T of the multi-body helmet 30 by increased flexibility in positioning magnets 26. Similarly, the multi-body helmet 30 can also facilitate or allow for greater choice in the location or position of the shield 20 with respect to a position, size, or shape of an opening, space, gap, or void 66, which is discussed in greater detail below.

The opening 66 can be formed within the multi-body helmet 30 between the outer surface 58 of the lower-body 50 and the inner surface 46 of the upper-body 40. The opening 66 can also be formed such that the outer limits, contours, or edges of the opening 66 can be formed, defined, or delineated by portions of the outer surface 58 of the lower-body 50 and the inner surface 46 of the upper-body 40 at a brow portion 32 of the multi-body helmet 30. The opening 66 can be sized and positioned within the multi-body helmet 30 to receive, or to be mateably coupled with, the shield mount 24 of the shield 20, which can be nested or concealed within the opening 66.

As such, at least a portion of the shield 20 and a portion of the opening 66 can be disposed or positioned near a center of the thickness T of the multi-body helmet 30. Similarly, the shield 20 and the opening 66 can also be disposed at any desirable position along the thickness T of the multi-body helmet 30, depending upon the configuration, design, position, and relative orientation of the upper-body 40 and the lower-body 50. Thus, the intermediate position of the opening 66 and the shield mount 24 can be along a line that extends radially between a center of the user's head to a point that is tangent with an outer surface of the helmet. Or, stated another way, the intermediate position of the opening 66 and the shield mount 24 can be between the inner and outer surfaces of the multi-body helmet 30, such as the inner surface 57 of the lower-body 50 and the outer surface 47 of the upper-body 40. In some embodiments, the position or location of the opening 66 can be adapted or formed to suit a need or preference of an individual user using the multi-body helmet 30. Adaption of the opening 66 to suit user preference or need can include as distance or offset from the face of the user and the position of the shield 20 resulting from the position of the opening 66. Adaption of the opening 66 to suit user preference or need can also include another feature or dimension of the user, such as a size, shape, or position of the user's head within the helmet.

Taking into account one or more of the locations of the magnets 26 within the multi-body helmet 30, as well as the size, position, or both, of the opening 66, an improved position of the magnetically coupled shield 20 can be provided for the multi-body helmet 30. The position of shield 20 can be improved by increased the number and range of positions at which the shield 20 can be magnetically coupled to the multi-body helmet 30. For example, in addition to placing the shield 20 or the shield mount 24 at the inner or outer surface of the helmet, the shield 20 or the shield mount 24 can also be placed at any of a plurality of distances along the thickness T of the multi-body helmet 30 to accommodate a range of distances between the user's face or eyes. The shield 20 or the shield mount 24 can also be placed so as to accommodate one or more of a size, shape, or position of the user's head or face within the multi-body helmet 30. The position of the shield 20 with respect to the multi-body helmet 30 and the face, eyes, or both, of a user can be customizable and achieved with relative ease because of the flexibility in changing a shape or form of one or more bodies of the multi-body helmet 30, such as for the upper-body 40 and the lower-body 50. As such, the position of the shield 20 can be determined by adjusting a size, shape, or position of the opening 66 by adjusting a size, shape, or position of the energy absorbing materials of the multi-body helmet 30, such as energy absorbing materials of the upper-body 40 and the lower-body 50. Stated another way, the position of the shield 20 does not need to rely on providing an intricate shield mount assembly that comprises adjusters, extenders, clips, or other structures to allow for adjust a position of the shield 20 with respect to a position of the user's eyes and face. Instead, by shifting at least a portion (and in some embodiments all) of the adjustment features for changing a position between the user's eyes and the shield 20 away from the shield mount assembly and to the energy absorbing materials of the multi-body helmet 30, such as energy absorbing materials of the upper-body 40 and the lower-body 50, the function and aesthetic of the helmet and shield is improved and simplified.

To the contrary, a conventional single-body helmet design, including an in-molded helmet design, will provide mounting surfaces for a shield on the outer surface of the helmet or on the inner surface of the helmet. Thus, a position of the mounted shield for a conventional design could not be placed at a central area or thickness of the helmet during a conventional in-molding process, at a distance that is optimal or desirable for a user, without adding mechanical complexity to the shield mount part, or employing a different mounting method besides, or in addition to, magnets.

The disadvantages of conventional designs, including those outlined above, are ameliorated with the multi-body helmet 30 and the shield 20 disclosed herein. By nesting or disposing the shield mount 24 within the opening 66, the shield mount 24 and the shield 20 can be releasably coupled to the multi-body helmet 30 with magnets 26 to automatically self-align the shield mount 24 within the opening 66. The self-alignment can occur by magnetic attraction between various magnets 26, such as between the magnet 26*a* of the shield mount assembly and corresponding magnets 26*b* and 26*c* embedded in the multi-body helmet 30. By using a simple shield mount 24 comprising the magnet 26*a*, the shield 20 can be simply, easily, and releasably coupled to the multi-body helmet 30 as shown in FIG. 1. As a non-limiting example, surfaces of the magnets 26 can be coplanar or substantially coplanar with each other by being in contact with each other or by being positioned at inner or outer surfaces of bodies of the multi-body helmet 30. For example, a surface of the magnet 26*a* coupled to the shield mount 24 can be coupled to, coplanar to, or in direct contact with, a surface of the magnet 26*b*, 26*c*, or 26*d*. As another example, a thin layer of material, such as PC shell or other material on a portion of the multi-body helmet 30 can be disposed between the closely aligned magnets 26 so that the magnets are not in direct contact or coplanar with each other, but include surfaces that are substantially coplanar with each other, being offset by the thickness of the thin layer of material. Furthermore, the design of the shield 20 and the multi-body helmet 30 comprising magnets 26 can provide flexibility and adaptability with respect to coupling the shield 20 to the multi-body helmet 30 in multiple different positions. The multiple or plurality of positions available for mounting the shield to the helmet can include a "rider" position shown in FIG. 4, a "visor" position shown in FIG. 5, and "storage" position shown in FIG. 6.

Figure 4:
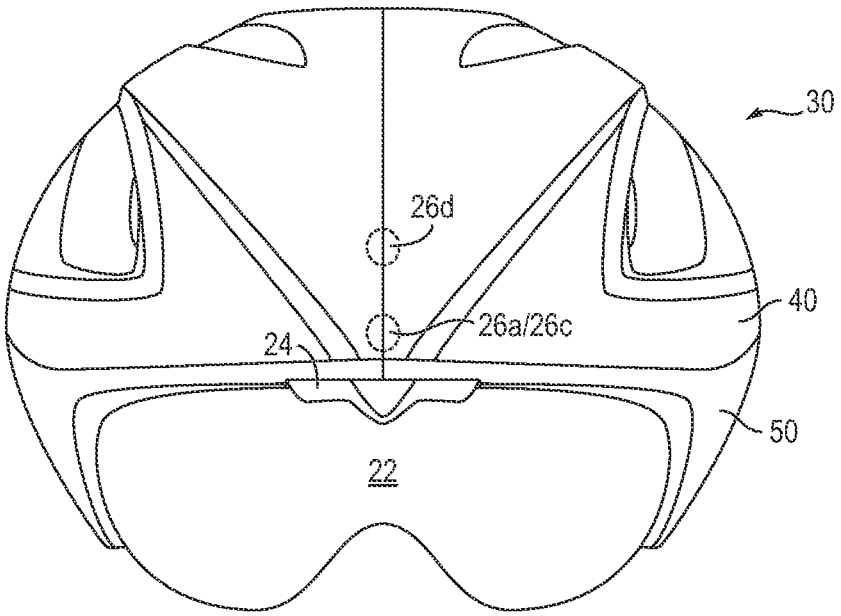
FIG. 4 shows a front profile view of a shield coupled to a multi-body helmet in a rider position.

FIG. 4 illustrates a profile view of a front of the multi-body helmet 30 with the shield 20 coupled in the rider position so that the lens 22 is aligned with the eyes of a user wearing the multi-body helmet 30. The rider position of the shield 20 can be achieved by inserting the shield mount 24 within the opening 66. The rider position of the shield 20 can be achieved easily and conveniently by the user because of the self-aligning magnetic coupling between the magnet 26*a* of the shield mount 24 and the magnet 26*b* or 26*c* disposed within the lower-body 50 or the upper-body 40, respectively. As such, the user can couple the shield 20 to the multi-body helmet 30 while in motion, such as while riding or cycling. The ability to attach the shield 20 to the multi-body helmet 30 while in motion is in contrast to conventional helmets comprising shield attachments that were difficult or cumbersome to attach, requiring the user to be stopped or have the helmet removed to couple the shield to the helmet.

Figure 5:
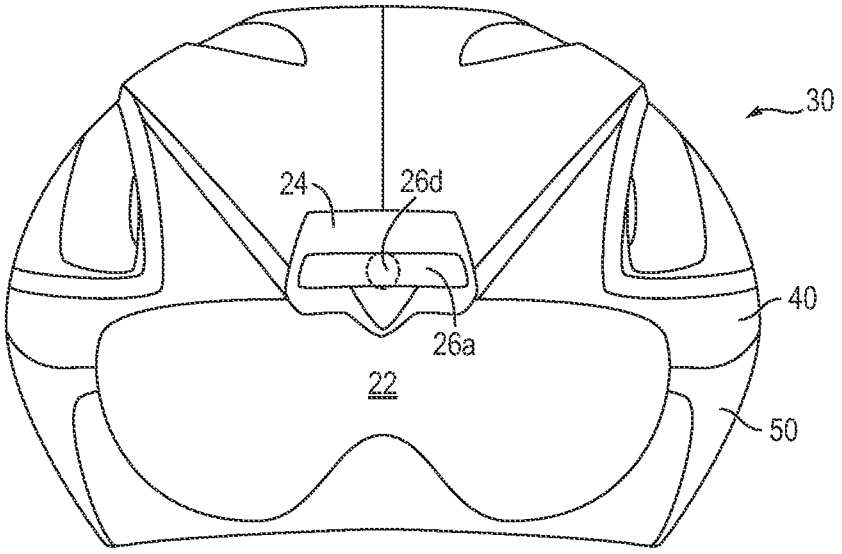
FIG. 5 shows a front profile view of a shield coupled to a multi-body helmet in a visor position.

FIG. 5 illustrates a profile view of a front of the multi-body helmet 30 similar to the view shown in FIG. 4. FIG. 5 differs from FIG. 4 in that the shield 20 is coupled in the visor position, rather than the rider position, so that the lens 22 is not directly aligned with the eyes of a user wearing the multi-body helmet 30 but includes the shield 20 elevated or raised up higher on the multi-body helmet 30. The visor position of the shield 20 can be achieved by placing the shield mount 24 outside of the opening 66 and in magnetic contact, or magnetically coupled, to the magnet 26*d* that is disposed above the magnets 26*b* and 26*c*. The visor position of the shield 20, like the rider position of the shield 20, can be achieved easily and conveniently by the user because of the self-aligning magnetic coupling. As such, the user can couple the shield 20 to the multi-body helmet 30 in the visor position while in motion, such as while riding or cycling. As a non-limiting example, a user may desire to switch from the rider position to the visor position during a ride or race, and can do so without stopping his cycle or removing the multi-bodied helmet 30. The ability to attach the shield 20 to the multi-body helmet 30 while in motion is in contrast to conventional helmets comprising shield attachments that were difficult or cumbersome to attach, requiring the user to be stopped or have the helmet removed to couple the shield to the helmet.

FIG. 6 illustrates a profile view of a front of the multi-body helmet 30 similar to the views shown in FIGS. 4 and 5. FIG. 6 differs from FIGS. 4 and 5 in that the shield 20 is coupled in the storage position, rather than the rider or visor position, so that the lens 22 is not aligned with the eyes of a user wearing the multi-body helmet 30, but is instead stored away from the user's eyes and face in an elevated or raised position higher up on the multi-body helmet 30. The storage position of the shield 20 can be achieved by placing the shield mount 24 outside of the opening 66 and in magnetic contact, or magnetically coupled, to the magnet 26*d* with the shield in an inverted or upside-down position. The storage position, like the visor position and the rider position of the shield 20, can be achieved easily and conveniently by the user because of the self-aligning magnetic coupling of magnets 26. As such, the user can couple the shield 20 to the multi-body helmet 30 in the storage position while in motion, such as while riding or cycling. As a non-limiting example, a user may desire to switch from the rider position or the visor position to the storage position during a ride or race, and can do so without stopping his cycle or removing the multi-bodied helmet 30. The ability to attach the shield 20 to the multi-body helmet 30 while in motion is in contrast to conventional helmets comprising shield attachments that were difficult or cumbersome to attach, requiring the user to be stopped or have the helmet removed to couple the shield to the helmet. By placing the shield 20 in the storage position, the shield is not visible to the user and does not interfere with a users sight, while at the same time remaining readily accessible and in a position to be easily placed back in a rider or visor position when desired. Furthermore, with the shield in the storage position, the shield is safe from being lost, damaged, or falling.

The multi-body helmet 30 comprising the magnetically mounted shield 20 can provide a number of advantages for cyclists or other helmet users. Advantages of the multi-body helmet 30 and shield 20 can comprise: (i) magnets 26 disposed within the multi-body helmet 30 to act as focus points or for self-alignment of the shield 20; (ii) the magnets can be disposed within energy-absorbing material of the multi-body helmet 30 during formation, such as during an in-molding process; (iii) the shield mount 24 can be coupled to a portion of the thickness of the multi-body helmet 30 away from an inner surface or exterior surface of the multi-body helmet 30; (iv) multiple densities of energy absorbing material, such as a first density in the upper-body 40 and a second density in the lower-body 50 can be easily accommodated do to the multi-body design; and (v) a helmet shape design and geometry can include a greater number of possibilities due to additional possible pull angles with various bodies of the multi-body design.

Accordingly, where the above examples, embodiments, and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations may be applied to other to helmet customization technologies as well. Accordingly, the disclosed subject matter is intended to embrace all such alterations, modifications and variations that fall within the spirit and scope of the disclosure and the knowledge of one of ordinary skill in the art.

What is claimed is:

1. A helmet comprising:

an upper-body comprising an upper outer shell and a separately formed upper energy-absorbing material coupled to the upper outer shell;

a lower-body comprising a lower outer shell and a separately formed lower energy-absorbing material coupled to the lower outer shell, wherein the lower-body is nested within the upper-body and a lower portion of the lower outer shell is disposed below, not covered by, and remains exposed with respect to, the upper-body when viewed from a side and not from a bottom of the helmet;

an opening formed within a front portion of the helmet and disposed between an outer surface of the upper-body and an inner surface of the lower-body;

a first magnet encased and in-molded within the upper energy-absorbing material without extending into the opening, the first magnet being disposed between the outer surface of the upper-body and an inner surface of the upper body, or encased and in-molded within the lower energy-absorbing material without extending into the opening, the first magnet being disposed between the inner surface of the lower-body and an outer surface of the lower body; and a shield comprising a shield mount and a second magnet coupled to the shield mount that is sized to fit within the opening and adapted to be releasably coupled to the first magnet with a magnetic field.

2. The helmet of claim 1, wherein the first magnet comprises a surface that is substantially coplanar with a surface of the opening.

3. The helmet of claim 1, wherein:

the upper-energy absorbing material comprises expanded polypropylene (EPP), expanded polystyrene (EPS), expanded polyurethane (EPU), or expanded polyolefin (EPO); and the lower-energy absorbing material comprises EPP, EPS, EPU, or EPO.

4. The helmet of claim 3, wherein:

the upper-energy absorbing material comprises a density in a range of 70-100 g/L; and the lower-energy absorbing material comprises a density in a range of 50-80 g/L.

5. The helmet of claim 1, wherein the first magnet and the second magnet are self-aligned with respect to each other such that the shield magnetically couples to the upper-body or the lower-body in direct alignment with eyes of a user.

6. The helmet of claim 1, further comprising:

a third magnet encased within the upper-body or the lower-body adjacent the first magnet; and the second magnet adapted to be coupled to both the first magnet and the third magnet.

7. A helmet comprising:

an upper-body;

a lower-body nested within the upper body such that a lower portion of the lower outer shell is not covered by, and remains exposed with respect to, the upper-body;

an opening formed within a front portion of the helmet and disposed between the upper-body and the lower-body;

a first magnet encased and in-molded within the upper-body without extending into the opening, the first magnet disposed between an outer surface of the upper-body and the opening or encased and in-molded within the lower-body without extending into the opening, the first magnet disposed between the inner surface of the lower-body and the opening; and a shield comprising a shield mount and a second magnet coupled to the shield mount that is sized to fit within the opening and to be releasably coupled to the first magnet.

8. The helmet of claim 7, wherein the first magnet is disposed between an outer surface of the upper-body and the opening or between an inner surface of the lower-body and the opening.

9. The helmet of claim 8, wherein the first magnet comprises a surface that is substantially coplanar with a surface of the opening.

10. The helmet of claim 7, wherein:

the upper-body comprises an upper energy-absorbing material comprising expanded polypropylene (EPP), expanded polystyrene (EPS), expanded polyurethane (EPU), or expanded polyolefin (EPO); and the lower-body comprises a lower energy-absorbing material comprises EPP, EPS, EPU, or EPO.

11. The helmet of claim 10, wherein:

the upper-energy absorbing material comprises a density in a range of 70-100 g/L; and the lower-energy absorbing material comprises a density in a range of 50-80 g/L.

12. The helmet of claim 7, wherein the first magnet and the second magnet are self-aligned with respect to each other such that the shield magnetically couples within the opening in direct alignment with eyes of a user.

13. The helmet of claim 7, further comprising:

a third magnet disposed within the upper-body or the lower-body and adjacent the first magnet; and the second magnet adapted to be coupled to both the first magnet and the third magnet.

14. A helmet comprising:

an upper-body;

a lower-body nested within the upper-body;

an opening formed between the upper-body and the lower-body;

a first magnetic component encased within the upper-body between an outer surface of the upper-body and the opening or encased within the lower-body between an inner surface of the lower-body and the opening; and a shield comprising a shield mount that is sized to fit within the opening and releasably couple to the first magnetic component; wherein the first magnet component is in-molded within the upper-body or the lower-body without extending into the opening.

15. The helmet of claim 14, wherein the shield is magnetically coupled within the opening.

16. The helmet of claim 15, further comprising:

the first magnetic component disposed between an outer surface of the upper-body and the opening or between an inner surface of the lower-body and the opening; and a second magnetic component coupled to the shield mount.

17. The helmet of claim 14, wherein:

the upper-body comprises an upper energy-absorbing material comprising expanded polypropylene (EPP), expanded polystyrene (EPS), expanded polyurethane (EPU), or expanded polyolefin (EPO); and the lower-body comprises a lower energy-absorbing material comprises EPP, EPS, EPU, or EPO.

18. The helmet of claim 14, further comprising:

the first magnetic component disposed within the upper-body or the lower-body;

a second magnet coupled to the shield mount so that the first magnetic component and the second magnetic component are self-aligned with respect to each other for the shield to be magnetically coupled within the opening in direct alignment with eyes of a user.

19. The helmet of claim 18, further comprising:

a third magnetic component disposed adjacent the first magnetic component; and the second magnetic component adapted to be coupled to both the first magnetic component and the third magnetic component being aligned such that the shield magnetically couples to an outer surface of the helmet out of sight from the eyes of the user.

* * * * *